US007275918B2

(12) United States Patent
Liang et al.

(10) Patent No.: US 7,275,918 B2
(45) Date of Patent: Oct. 2, 2007

(54) SCROLL APPARATUS WITH AN AXIAL GAP CONTROL FUNCTION

(75) Inventors: Kun-Yi Liang, Hsin Chu Hsien (TW); Shu-Er Huang, Hsin Chu (TW); Chun-Chung Yang, Hsin Chu (TW); Yu-Choung Chang, Hsin Chu Hsien (TW); Hung-Chi Chen, Tai Chung (TW)

(73) Assignee: Industrial Technology Research Institute, Hsinchu County (TW)

( * ) Notice: Subject to any disclaimer, the term of this patent is extended or adjusted under 35 U.S.C. 154(b) by 0 days.

(21) Appl. No.: 11/320,646

(22) Filed: Dec. 30, 2005

(65) Prior Publication Data

US 2006/0147331 A1 Jul. 6, 2006

(30) Foreign Application Priority Data

Dec. 31, 2004 (TW) ..... 93141918 A

(51) Int. Cl.
*F03C 2/00* (2006.01)
*F04C 2/00* (2006.01)

(52) U.S. Cl. ..... 418/55.5; 418/55.1; 418/57; 418/152; 418/179

(58) Field of Classification Search ..... 418/55.1–55.6, 418/57, 152, 179
See application file for complete search history.

(56) References Cited

U.S. PATENT DOCUMENTS

| | | | | |
|---|---|---|---|---|
| 5,407,335 A | | 4/1995 | Caillat et al. | |
| 5,743,720 A | | 4/1998 | Sano et al. | |
| 5,897,306 A | * | 4/1999 | Beck | 418/55.5 |
| 6,368,088 B1 | * | 4/2002 | Hsiao et al. | 418/55.5 |
| 6,565,338 B1 | * | 5/2003 | Chang et al. | 418/55.1 |

FOREIGN PATENT DOCUMENTS

| | | | | |
|---|---|---|---|---|
| JP | 02009978 A | * | 1/1990 | 418/55.5 |
| JP | 03237283 A | * | 10/1991 | 418/55.5 |
| JP | 06026471 A | * | 2/1994 | 418/55.5 |
| KR | 2005027406 A | * | 3/2005 | |
| TW | 586580 | | 5/2004 | |

* cited by examiner

*Primary Examiner*—Theresa Trieu
(74) *Attorney, Agent, or Firm*—Rabin & Berdo, P.C.

(57) ABSTRACT

A scroll apparatus with an axial gap control function is described. The scroll apparatus is capable of controlling the axial gap between its fixed scroll and orbiting scroll. The scroll apparatus has a frame with a pair of indentations installed in the casing of the scroll apparatus, a pair of flexible elements installed at the lateral side top of the frame and spanning the pair of indentations for defining a suspended flexible segment at the span, a sidewall having a positioning ring with a downward protruding body corresponding to the indentation, in which the protruding body of the positioning ring is fixed to the flexible segment of the flexible element, a fixed scroll suspended at the positioning ring, and an orbiting scroll for orbiting into the fixed scroll.

4 Claims, 3 Drawing Sheets

SCROLL APPARATUS WITH AN AXIAL GAP CONTROL FUNCTION

BACKGROUND OF THE INVENTION

1. Field of the Invention

The present invention relates to a scroll apparatus with an axial gap control function, and more particularly to a scroll apparatus capable of controlling the axial gap between a fixed scroll and an orbiting scroll of the scroll apparatus.

2. Description of Related Art

As a traditional scroll apparatus such as a scroll compressor inevitably comes with two substantial drawbacks as described below.

Firstly, when the traditional scroll compressor shuts down, its fixed scroll is in contact with its orbiting scroll, thus giving rise to an increase of frictional force when the scroll compressor is started again.

Secondly, the flange disposed at the top of a frame, a positioning pin and an axial gap plate are fixed at their center to prevent the fixed scroll from rotating. However, the flange, positioning pin and axial gap plate collide with each other during the operation of the scroll compressor, not only making noise, but also giving rise to a leak to the chamber of the scroll compressor. Further, improper wear will occur at the lateral surface and the end surface between the fixed scroll and the orbiting scroll and will reduce the life of use and the reliability of the scroll compressor.

In present scroll compressor related patents, each of these prior arts has its advantages and disadvantages, but none of them can totally overcome the aforementioned shortcomings.

R.O.C. Patent Publication No. 586580 entitled "Improved scroll compressor pump assembly" is illustrated in FIGS. 1 and 2. The compressor 7 comprises an orbiting scroll 74, a fixed scroll 72, a press member 71, a circular base 73, a fixture (not numbered in the figure) for fixing the orbiting scroll 74 and the fixed scroll 72, and a frame 75 mounted into a housing (not shown in the figure) of the compressor. The fixture is fixed onto the periphery of the frame 75 corresponding to the fixed scroll 72 by at least two positioning bases 731, and the positioning bases 731 are fixed onto the frame 75 by the circular base 73. The circular base 73 is coupled with the frame 75 after the frame 75 is fixed inside the housing. The press member 71 is correspondingly fixed to the top of the positioning base 731 and the press member 71 presses on and fixes the fixed scroll 72 and the frame 75, such that an Oldham ring 751 still can be installed between the orbiting scroll 74 and the frame 75, and the limit section 752 of the Oldham ring 751 is provided for limiting the moving direction of the orbiting scroll 74. The fixture still can limit the revolving movement of the orbiting scroll 74 with respect to the fixed scroll 72 and prohibit any rotation so as to change the volume of the compression chamber of the fixed scroll and produce a compression effect to a refrigerant. Therefore, the objective of this prior art resides on reducing any deformation of the mechanical structure during the assembling process of the frame and the housing. Its function resides in improving the assembling precision of the positioning base and the fixed scroll. Its effect resides on changing the volume of the compression chamber of the fixed scroll and the orbiting scroll to produce a compression effect to a refrigerant. Its disadvantages include an increased number of components (press plate), a louder noise (rotation and axial gap) and a large stan-up frictional force.

As disclosed in U.S. Pat. No. 5,407,335, a compressor includes a frame inside a housing, and the frame supports a second scroll and adds a guide post for fixing a fixed scroll into its position and determining the total axial displacement. A circular plate is provided for preventing the rotary movement and axial movement of the fixed scroll, and the guide post is coupled to an end surface of the circular plate, and then secured to the frame by bolts. Therefore, the objective of this prior art is to prevent the axial and rotary movements of the fixed scroll. Its function is to provide an axial compliant function. Its effect is to seal the compression chamber of the fixed scroll and the orbiting scroll and produce a compression effect for the refrigerant. Its advantages includes a more precise positioning of the fixed scroll, a lower noise, and a smaller start-up frictional force. Its disadvantages include an increased number of components and a more complicated axial gap control, which causes a breakdown easily.

As disclosed in U.S. Pat. No. 5,743,720, the fixed scroll is mounted vertically downward to its fixed ring, and its plate spring is installed between its fixed scroll and fixed ring. Therefore, this prior art has the advantages of a reduced number of components, a more precise positioning of the fixed scroll, a lower noise and a smaller start-up frictional force. However, the axial gap control between the two scrolls is still too complicated and will cause a breakdown easily due to its improper control method.

In other words, the aforementioned prior arts have their advantages and disadvantages, but none of them can totally overcome the shortcomings of the prior arts and definitely require further improvements.

SUMMARY OF THE INVENTION

Therefore, it is a primary objective of the present invention to provide a scroll apparatus with an axial gap control function and makes use of the axial compliance to give effectively a fixed gap control function (producing the maximum gap for the total axial displacement) when the scroll apparatus is shut down so as to reduce the frictional force at the start-up stage and the noise produced during its operation.

Another objective of the present invention is to provide a scroll apparatus with an axial gap control function and adopts a suspension design for its axial compliance. When the scroll apparatus is operating, a lateral side top of the fixed scroll when pressed by external forces still can effectively use a small elastic deformation produced by a specially installed flexible element to restrict the fixed scroll for an axial compliance only and being closely attached on the top of the orbiting scroll, and thus can further prevent a leak of the compression chamber.

Another further objective of the present invention to provide a scroll apparatus with an axial gap control function that effectively restricts the axial movement of the fixed scroll from moving with respect to any other components during the compression process, and uses its flexible element to prevent the axial and rotary movements of the fixed scroll so as to avoid the collisions between the metal components, improve the noise problem of the scroll apparatus (compressor), avoid damages to the component of the scroll apparatus, and enhance the performance and reliability of the scroll apparatus.

To achieve the foregoing objectives, the present invention provides a scroll apparatus with an axial gap control function. A frame is disposed in a housing of the scroll apparatus and has an indentation at the periphery of the frame. A flexible element is disposed at the lateral side top of the frame and spans the indentation of the frame. The span defines a flexible segment. A positioning ring has a sidewall that includes a protruding body corresponding to the indentation. The flexible segment of the flexible element is coupled with the protruding body of the positioning ring. A fixed scroll is suspended at the positioning ring. An orbiting scroll, for orbiting in the fixed scroll and the fixed scroll, is situated between the positioning ring and the frame.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENTS

The above and other objects, features and advantages of the present invention will become apparent from the following detailed description taken with the accompanying drawing.

Figure 1:
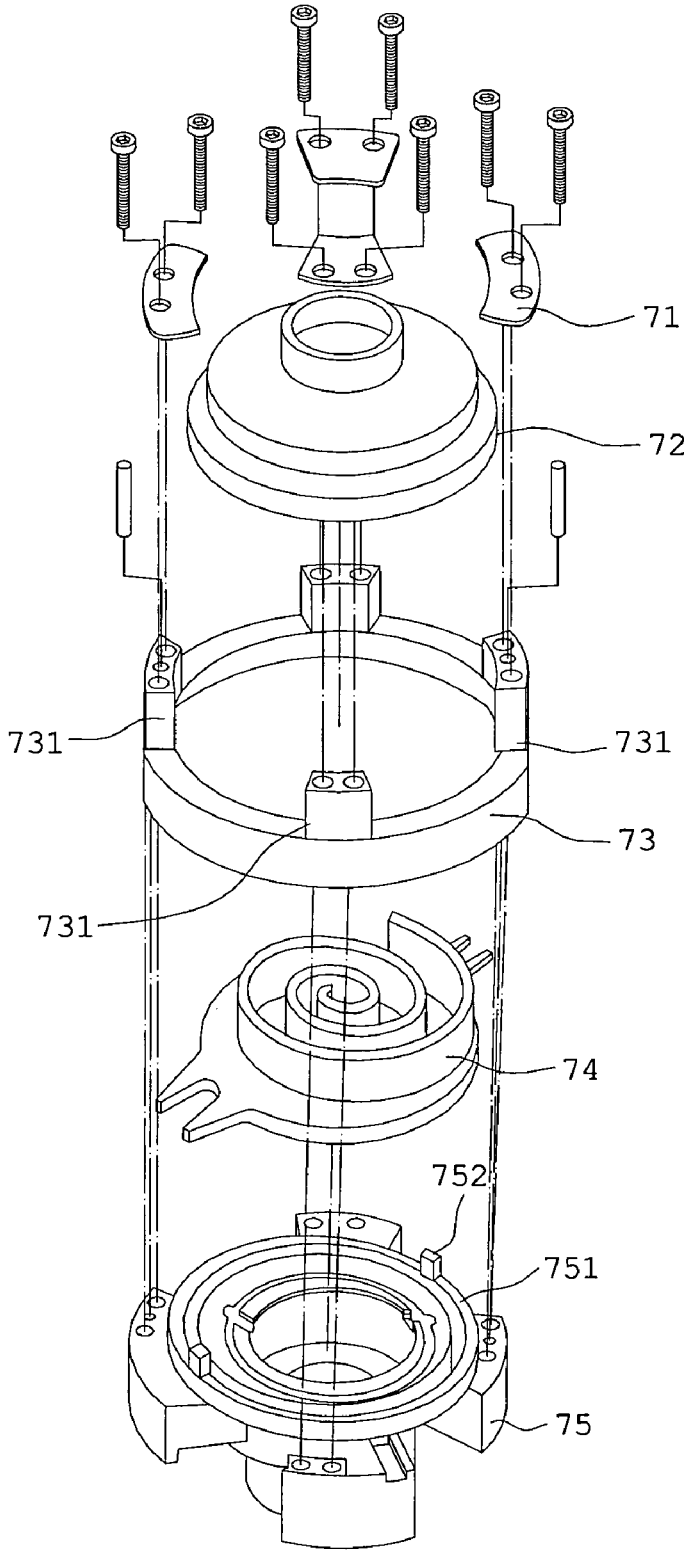
FIG.1 PRIOR ART
FIG. 1 is an exploded view of a prior art as disclosed in the R.O.C. Pat. No. 586580.
Figure 2:
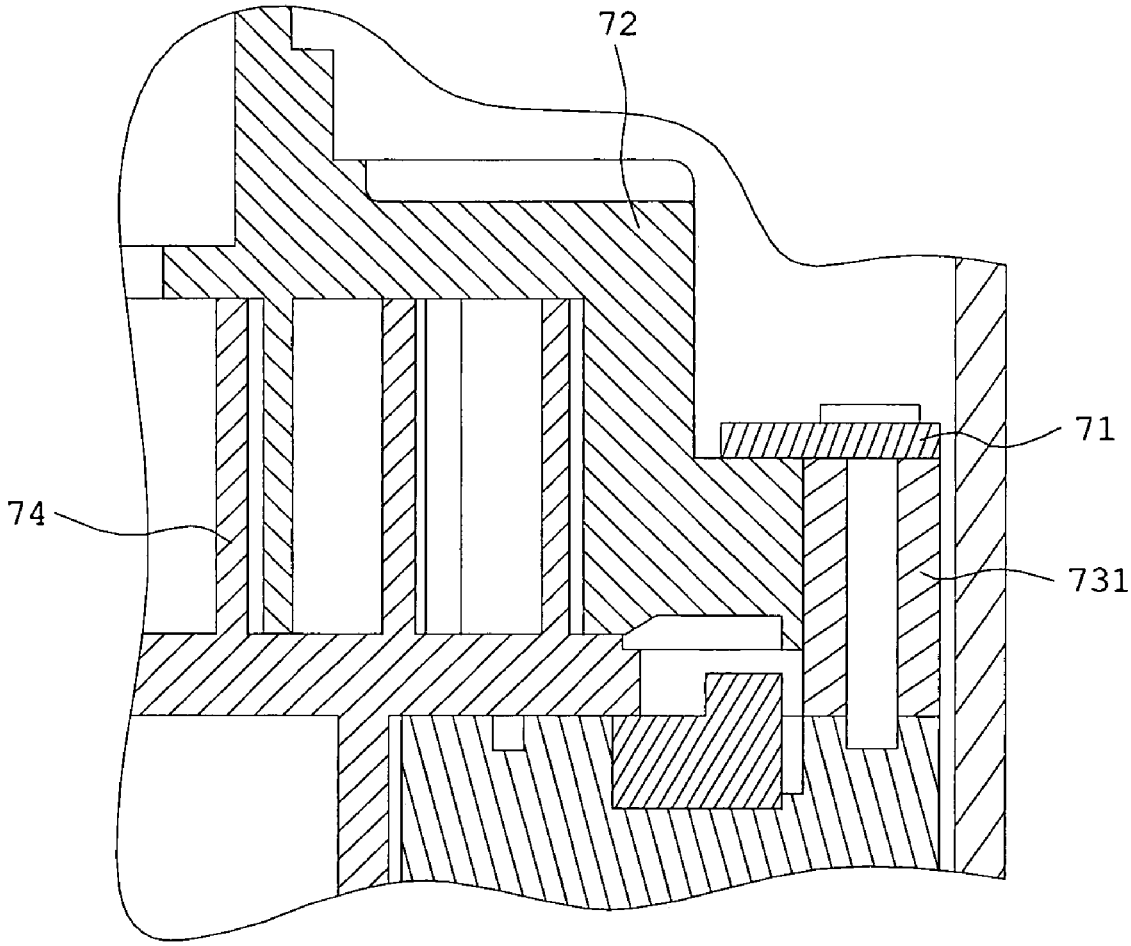
FIG.2 PRIOR ART
FIG. 2 is an enlarged view of a portion of the assembled structure as depicted in FIG. 1.
Figure 3:
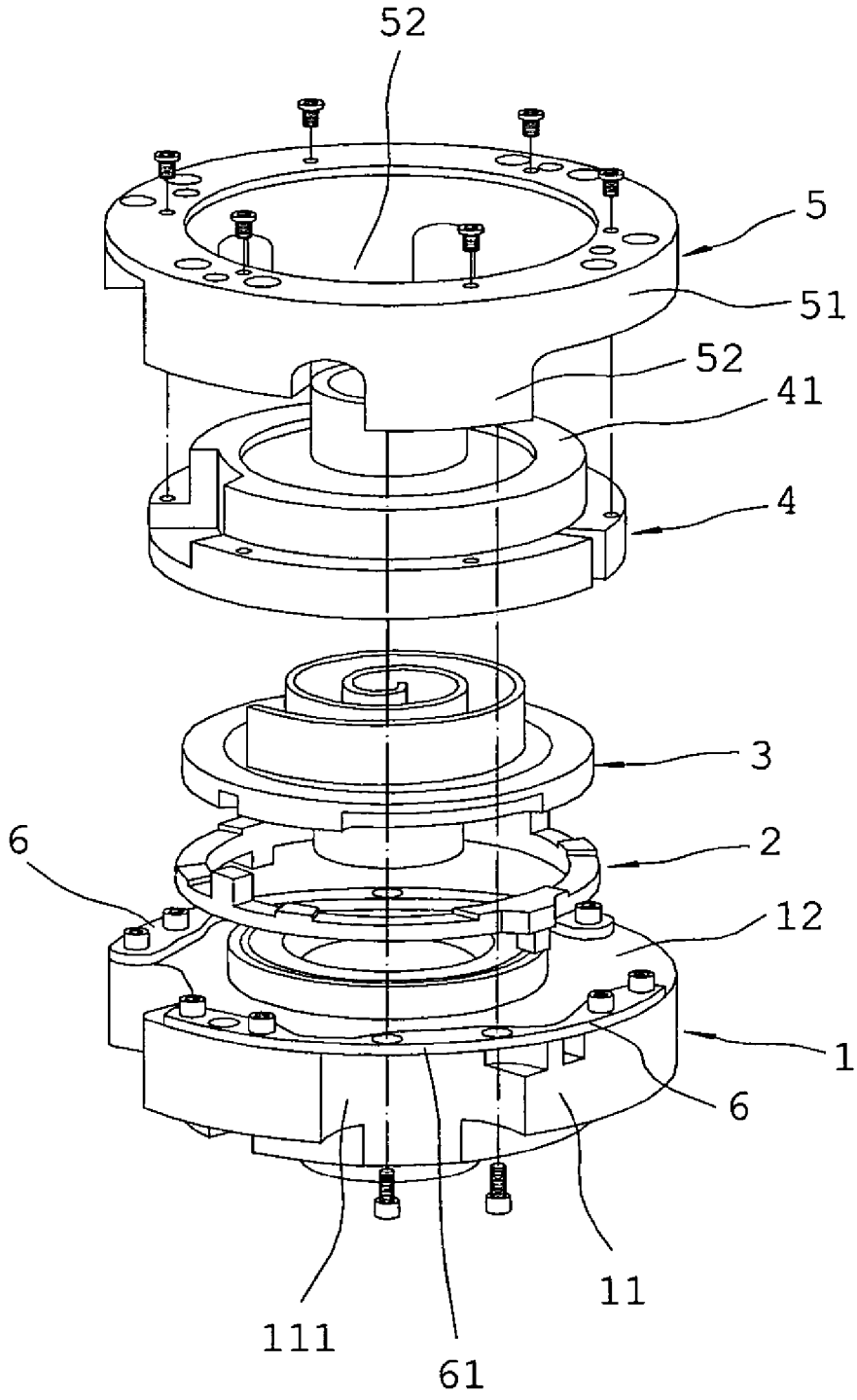
FIG. 3 is an exploded view of the present invention.

Reference is made to FIG. 3 for a scroll apparatus with an axial gap control function according to the present invention, which particularly provides a fixed gap control function when the scroll apparatus is shut down, so as to reduce the frictional force at the start-up stage and the noise produced during its operation. The scroll apparatus comprises an orbiting scroll 3, a fixed scroll 4, a positioning ring 5, a flexible element 6, and a frame 1 installed inside a housing (not shown in the figure) of the scroll apparatus.

The frame 1 is disposed inside the housing (not shown in the figure) of the scroll apparatus, and a pair of indentations 111 is disposed at the periphery 11 of the frame 1.

The pair of flexible elements 6 are, for example, of a metal beam type and disposed along the periphery of the lateral side top 12 of the frame 1 onto the lateral side top 12 of the frame 1, such that the pair of flexible elements 6 span across the indentations 111 corresponding to the frame 1, and the span between the pair of flexible elements 6 defines a suspending flexible segment 61 that has a flexible function.

The positioning ring 5 is an annular ring and its sidewall 51 has a protruding body 52 corresponding to the foregoing indentation 111, and the flexible segment 61 of the flexible element 6 is used to couple with an end of the protruding body 52 of the positioning ring 5.

The fixed scroll 4 is sleeved into a hollow of the positioning ring 5, and the fixed scroll 4 and the top and bottom of the positioning ring 5 are coupled together so as to suspend the fixed scroll 4 at the positioning ring 5.

The orbiting scroll 3 is orbited in the fixed scroll 4 and the bottom of the orbiting scroll 3 is situated at a lateral side top 12 of the frame 1, and a circular body 2 is disposed between the orbiting scroll 3 and the lateral side top 12 of the frame 1.

The positioning ring 5 is fixed to each flexible segment 61 of the corresponding flexible element 6 by the end sections of the two protruded bodies 62, such that the axial movement of the fixed scroll 4 drives the positioning ring 5 to press the pair of protruded bodies 52 down to the corresponding segment 61, and each flexible segment 61 will produce a corresponding small elastic deformation. The fixed scroll 4, orbiting scroll 3 and circular body 2 are situated between the positioning ring 5 and the frame 1.

Since the flexible element 6 having a flexible segment 61 with a flexible (resilient) function acts on the positioning ring 5, the positioning ring 5 can have a slight axial displacement. The fixed scroll 4 is coupled with the positioning ring 5 by a suspension method for an axial link, and thus if the lateral side top 41 of the fixed scroll 4 is pressed to move the fixed scroll 4 downward, the positioning ring 5 will move downward accordingly, and the pair of protruded bodies 52 of the positioning ring 5 are used to press on the flexible segment 61 of the flexible element 6, such that the fixed scroll 4 has the axial compliance effect for the axial displacement and preventing any displacement other than such axial displacement, so as to achieve a constant axial gap control effect and other corresponding effects.

In view of the description above, the present invention has the following effects:

1. The control functions according to the preferred embodiment of the invention can effectively provide a constant gap control function when the scroll apparatus (such as a compressor) is shut down, so as to reduce the frictional force at the start-up stage and the noise produce during its operation.

2. When the scroll apparatus is operating, the lateral top side 41 of the fixed scroll 4 is pressed by forces, the flexible element 6 specially designed according to the present invention still can produce a small elastic deformation, so that the fixed scroll 4 is restricted to the axial compliance only and thus can prevent a leak to the compression chamber.

3. The invention also can effectively prevent the fixed scroll 4 from its axial or rotary movements to avoid the collision produced between the metal components and thus further improve the long-existing noise problem of the scroll apparatus.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims, which are to be accorded with the broadest interpretation so as to encompass all such modifications and similar structures.

What is claimed is:

1. A scroll apparatus with an axial gap control function, comprising:

a frame locatable in a housing of said scroll apparatus and having an indentation in a side periphery thereof;

a flexible element disposed on a lateral side of a top of said frame and having a suspended flexible segment that spans said indentation of said frame;

a positioning ring, having a sidewall comprising a protruding body disposed in alignment with said indentation, said suspended flexible segment of said flexible element being fixed with said protruding body of said positioning ring, said positioning ring being axially displaceable due to a flexing of said flexible segment;

a fixed scroll suspended at said positioning ring; and an orbiting scroll, for orbiting in said fixed scroll, said orbiting scroll being situated between said positioning ring and said frame.

2. The scroll apparatus with an axial gap control function of claim 1, wherein said fixed scroll is sleeved into a hollow of said positioning ring and said fixed scroll is coupled between a top and bottom of said positioning ring.

3. The scroll apparatus with an axial gap control function of claim 1, wherein said flexible element is a metal beam.

4. The scroll apparatus with an axial gap control function of claim 1, further comprising a circular body disposed between said orbiting scroll and the lateral top side of said frame.

* * * * *